United States Patent [19]

Kurokawa

[11] 4,247,802

[45] Jan. 27, 1981

[54] SELF SHIFT TYPE GAS DISCHARGE PANEL AND SYSTEM FOR DRIVING THE SAME

[75] Inventor: Kaneyuki Kurokawa, Tokyo, Japan

[73] Assignee: Fujitsu Limited, Kanagawa, Japan

[21] Appl. No.: 971,694

[22] Filed: Dec. 21, 1978

[30] Foreign Application Priority Data

Dec. 27, 1977 [JP] Japan ..... 52-159574

[51] Int. Cl.[3] ..... H05B 41/36

[52] U.S. Cl. ..... 315/169.2; 313/217; 340/769; 340/792

[58] Field of Search ..... 315/169.2, 169.4; 340/711, 769, 792; 313/217

[56] References Cited

U.S. PATENT DOCUMENTS

| | | | |
|---|---|---|---|
| 3,944,875 | 3/1976 | Owaki et al. | 340/769 |
| 4,090,109 | 5/1978 | Ryan et al. | 315/169.4 X |

*Primary Examiner*—Eugene R. LaRoche
*Attorney, Agent, or Firm*—Staas & Halsey

[57] ABSTRACT

A self shift type gas discharge panel has a display screen with a plurality of shift lines in the vertical direction, and a new driving system is provided for the panel. The display screen is divided horizontally into two areas, an upper part having display rows and a lower part having monitor rows, and these monitor and display rows are configured to allow independent shift operation. Thus, relevant data is written from underneath into the bottom monitor row by a one-data-input-and-refresh method, and when the writing into this monitor row is completed, the data in this single row is scrolled up into the display rows. The configuration makes it possible to write data into a desired position in the monitor rows and to amend easily the data already written, resulting in improved operability.

14 Claims, 7 Drawing Figures

SELF SHIFT TYPE GAS DISCHARGE PANEL AND SYSTEM FOR DRIVING THE SAME

BACKGROUND OF THE INVENTION

1. Field of the Invention

This invention relates to an improvement of the AC driven self shift type gas discharge panel, and more specifically to a new self shift gas discharge panel with improved operability and display employing vertical shift and to a system for driving the same.

2. Description of the Prior Art

The AC driven type gas discharge panel is well known as a display device utilizing gas discharge. This panel, however, requires many drivers for operation so long as it employs a matrix addressing configuration, and the drivers and associated electronic circuits become very expensive. Thus, the self shift type gas discharge panel has been proposed in view of solving such disadvantages of the matrix address system and this type of panel is now under further development.

The self shift type gas discharge panel is basically composed of a panel providing shift channels formed by a periodic arrangement of discharge cells of plural groups with each group generally being driven with a different electrical phase. This driving is such that the discharge spots generated by application of write voltage to the write discharge cells provided at one end of each shift channel are sequentially shifted by making use of the coupling effect between adjacent cells.

As self shift type gas discharge panels of this type, for example, the following are well known; those employing the matrix electrode configuration as is disclosed in U.S. Pat. No. 3,944,875 by Owaki et al. which has been assigned to the same assigned as the present invention; those employing the parallel electrode configuration as shown in U.S. Pat. No. 3,775,764 by J. P. Gaur; and those employing the meander electrode arrangement and the meander channel configuration shown in U.S. Patent application Ser. Nos. 813,627 and 810,747 by Yoshikawa et al. which have been proposed recently and assigned to the same assigned as the present invention.

These self shift panels provide the advantage that they can drastically reduce the number of drivers needed for the common electrodes of the X side or the Y side in the address system (only three or four drivers are required).

On the other hand, however, the known self shift type gas discharge panels have the following disadvantage when used for monitor and keyboard display in a computer terminal. Namely, the self shift displays using such known panels have a configuration in which the data written at the extreme right side of a shift line is horizontally shifted from right to left. Thus the interruption of the display while the data written at the extreme right side of the shift line is shifted to the final display position, is a major cause of operator fatigue. In addition, it is desirable that the keyed-in data be displayed sequentially at the final display position from the left side of the screen each time the data is keyed in, but the known self shift display has the disadvantage that the final display position of each data point cannot be confirmed at the keying time. Here, it may be possible that data of as much as a single row including the data which is previously displayed are updated by using an external memory each time data is input, and thereby display can always be performed at the final display position. However, this method is not practical because the writing speed becomes slower than the keying in operation as the number of data to be displayed in a single row increases, and operator fatique becomes more excessive due to flickering. For example, when the three-character data of "A, B, C" is written by the abovementioned refresh writing for each data point in the panel having the known horizontal shift configuration, the writing operation has the sequence of FIG. 1 (*a*), (*b*) and (*c*). However, since the time required for shifting a discharge spot between adjacent display positions in known driving systems is about 0.4 msec, a time of about 288 msec is required when $7\times9$ dots correspond to one character and 80 characters are to be displayed in a single row with an inter-character spacing of 2 dots $[(7+2)\times80\times0.4=288]$.

Moreover, for the known self shift type display, random addressing is impossible and therefore if an error is found in the displayed data, all the data of a single row must be updated from the beginning. Thereby, operation is very complicated and time is wasted. In addition, it is very difficult in the existing self shift display to realize revision and tabulation with use of a cursor as can be done with the ordinary matrix display.

SUMMARY OF THE INVENTION

The present invention offers a self shift type gas discharge panel with an improved display mode and improved operability in order to meet the requirements of various terminal displays, and a driving system for the same.

In more detail it is an object to offer a self shift type gas discharge panel with a vertical shift system in which characters can be input immediately to the display position and in which the input time can be minimized by the keyboard operation, and a driving system for the same.

It is another object of the present invention to offer a vertical shift system which reduces operator fatigue by eliminating an unstable display accompanying the writing operation.

It is a further object of the present invention to offer an improved self shift display which can realize easily the editing function such as revision of data input and tabulation.

It is still a further object of the present invention to offer a self shift display wherein the function is improved without causing the cost of the driver circuit for driving the panel to go up.

Briefly speaking, focusing on the disadvantage of a known self shift display which results from the horizontal shift operation from the right to the left, for example the present invention is characterized by the configuration of a self shift type gas discharge panel which enables vertical shift operation instead of such horizontal shift operation. Namely, according to the present invention, in order to realize data input and display by means of such vertical shift operation, in a self shift type gas discharge panel in which the display screen comprises parallel plural lines of shift channels defined by periodic arrangements of discharge cells of plural group, the electrode arrangement for defining each said shift channel is electrically divided for defining each respective screen area, so that said display screen is divided at least in to two areas in a direction at right angles to the shift lines. The write electrodes for defining the write discharge cells are provided at one end of each shift channel at the side of of at least one display area of the total display area as divided above into at least two areas.

Moreover, according to the present invention, a new driving system is employed wherein the one display area two which is adjacent to the write discharge cells is considered as the monitor row, while the other display area is considered as the display rows. The shift driver circuits are individually connected to the electrode arrangement of each of said display areas so that the shift operation of both the monitor row and display rows is performed independently. The write electrodes are connected with a refreshable memory provide memory to capacity corresponding to the number of data to be displayed in the monitor row after writing via the write driver circuit.

The write operation into said monitor row and the resultant shift operation are individually performed under the condition that the data displayed in said display rows is maintained.

The terms "vertical direction" in the present invention not only means the vertical direction on the display area but also the direction perpendicular to the direction along which the data to be displayed is to be read. "Data" in the present invention means the ordinary alphanumeric data as well as symbols.

Other objects and characteristics of the present invention will be understood more clearly by the explanation for the preferred embodiment described hereunder by referring to the drawings.

DESCRIPTION OF THE PREFERRED EMBODIMENTS

Figure 1:
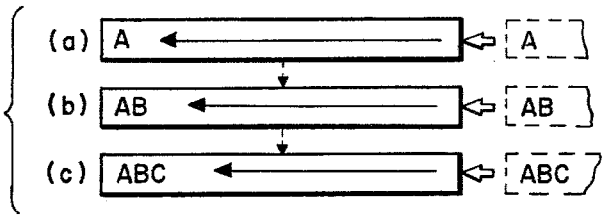
FIG. 1 shows a diagram the known data writing sequence of the self shift display.
Figure 2:
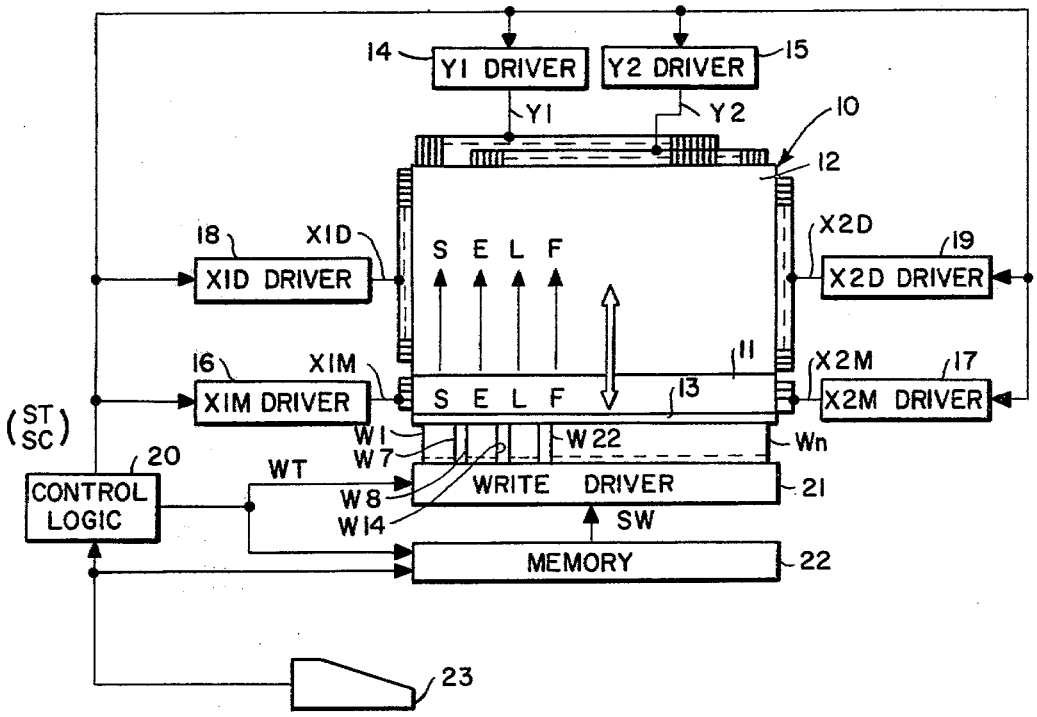
FIG. 2 shows a block diagram indicating an embodiment of the configuration and driving system of the self shift type gas discharge panel in accordance with the present invention.

In FIG. 2, the display screen of the self shift type gas discharge panel (hereinafter referred to a self shift PDP) 10 is divided into two areas with one display area forming the monitor row area 11 and another display area forming the display row area 12. In other words, this self shift PDP 10 is configured by the meander electrode arrangement of 2×2 phases as will be explained later, for example, and provides many vertical shift channels which are defined by such an electrode arrangement. But, only the 2-phase shift electrode groups on the one substrate which are connected to the terminals Y1, Y2 are extended via the bus which is used in common for the entire display screen, while the other 2-phase shift electrode groups on the other substrate are individually extended to the terminals XIM and X2M, XID and X2D respectively for the monitor row area 11 and display row 12. The monitor row area 11 in the lower area of the display screen can have a width which is sufficient for making possible data display of a single row, as in shown the lower part of FIG. 2. The write discharge cell row 13 has one write electrode corresponding to each shift channel extending in the vertical direction W1, W2, . . . , Wn.

The two shift electrode terminals Y1 and Y2 which extend in common to the entire portion of the display screen are connected with the Y side shift driver circuits 14 and 15, while X side shift electrode terminals XIM, X2M and XID, X2D of each display are respectively connected with a pair of X side shift driver circuits 16, 17 and 18, 19. These shift driver circuits receive the specified drive timing signal st and selection command signal sc from the control logic circuit 20 and thereby attain selective shift operation for the monitor row area 11 and display row area 12. In addition, the write electrode terminals W1 to Wn are connected with the write drive circuit 21 respectively corresponding to the electrodes in the case of the above figure, and thus simultaneous writing for each line (one line at a time) can be performed responding to the write data signal SW sent from the editing memory 22 and the write timing signal WT sent from the control logic circuit 20.

Figure 3:
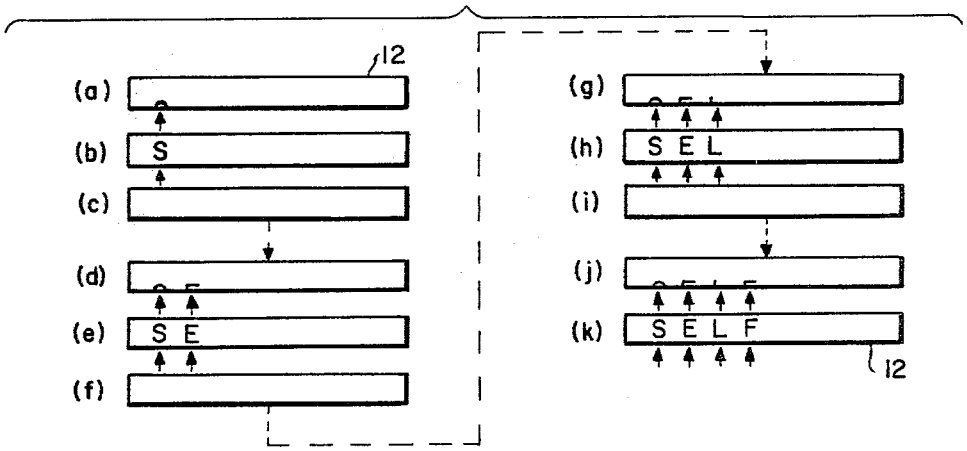
FIG. 3 shows a diagram of the data writing sequence in accordance with the present invention.

In the abovementioned configuration, for the example that it is desired to read the word "SELF" from the keyboard and to display it, the following operations are conducted. Namely, FIG. 3 shows a diagram of the write operation sequence. In this figure, when the data indicating the letter "S" is keyed in, the monitor row 11 is put in the vertical shift operation mode by the driving from the Y side drive circuits 14, 15 and X side shift drive circuits 16, 17, and seven (7) write electrodes W1 to W7 corresponding to seven (7) shift channels in the left side of the monitor row 11 are sequentially selected for nine (9) times in synchronization with said shift operation period. As a result, data of the first letter "S" having the 7×9 dot configuration is written into the monitor area as shown in FIGS. 3*a* and 3*b*. When data indicating a letter "E" is keyed in, such data is first stored in the specified area of the editing memory 22 together with the data of the letter "S" and the data of letter "S" written precedingly in the monitor row is erased as shown in FIG. 3*c*, prior to the write operation.

This erasure operation can be performed as follow: the shift operation for the display 12 is continued while the monitor row area 11 is put into an inoperative condition and thereby the discharge spots which are contributing to the display are sequentially erased in such a way as exhausting them, as for instance, in sequence from the top line of horizontal discharge spot of the monitor row. As an another erasure operation, discharge spots in the entire area of the monitor row can be erased at one time by applying the erase pulse signal to the X side shift electrode terminals XIM and X2M of the monitor row.

Of such erasing methods, however, the latter total erasing method has more advantage than the former one from a practical view point because a wider erasing operation margin can be obtained, so that the erasing operation is reliable and erasing can be performed within a very short period of time.

The displays of the monitor row area 11 is erased at one time by the process as mentioned above and then the data of letters "S" and "E" which are stored in the editing memory 22 are sequentially written in parallel into the write electrodes W1 to W7 which configure the first unit display block and the write electrodes W8 to W14 which configure the next unit display block and as a result "SE" is displayed on the monitor row area 11. Such writing operation mode is shown in FIGS. 3*d* and 3*e*. Then, when the data indicating a letter "L" is keyed in, the data representing this letter is stored in the specified area of the editing memory 22 and the erasing operation as shown in FIG. 3*f* is performed for the letters "SE" displayed in the monitor row area 11. Then, data of three letters "SEL" including the preceding displayed letters "SE" are read out in parallel from the editing memory 22 and then written into the predetermined display block location of the monitor row area 11. Such writing processes are shown in FIGS. 3*g* and 3*h*.

Moreover, when data indicating a letter "F" is keyed in, the similar erasing operation and parallel writing operation via the storing operation for the editing memory are repeated as shown in FIGS. 3*j* and 3*k*, and the word "SELF" is displayed on the monitor row area 11 as shown in FIG. 2.

Thus, in the present invention, the keyed-in data are displayed at the final display position of the monitor row area by a shift operation of only nine (9) cycles.

Therefore, the time taken for data writing is drastically shortened and the amount of flickering resulting from the shift operation is also reduced, thereby greatly alleviating operator fatigue. In addition, since the keyed-in data are immediately displayed at the final display position of the monitor row area where it is sustained, operability is outstandingly improved.

When data for a single row is written into the monitor row area 11 and such content is confirmed, the entire display panel area is put into the shift operation mode by driving in common the two pairs of X side shift driver circuits 16, 17 and 18, 19 and the display of the monitor row area 11 is scrolled up to a predetermined display block position of the upper display row area 12. Then, data of the next row is written into the monitor row area 11 by the same method as mentioned above. Thus, an entire display frame can be obtained by repeating such writing operation to the monitor row area 11 and scrolling up to the predetermined display block of the display row area 12. Of course, the monitor row area 11 and display row area 12 are divided so that the driving for latter can be made individually while the writing operation is performed for the monitor row area 11. During this writing function, data in the display row area 12 is sustained in the display condition. In order to individually sustain the data in the display row area 12, it is desirable to introduce the method of sway shift which is disclosed in the U.S. patent application Ser. No. 906,342 by Kashiwara et al, assigned to the same assignee as the present invention, and which will be described below in detail.

When an error is found in the data displayed in the monitor row area 11 or display area 12, or if revision is required, if such revision is required only for the monitor row area 11, then re-writing is performed by revising the data stored in the relevant location of the editing memory 22. If such revision is required for the data displayed in the display row area 12, the entire display down to the monitor row area 11 by reverse shifting and a similar revision can be made therein by using the editing memory 22.

It is desirable to increase the capacity of the editing memory and to make use of a cursor in order to optimize the revision and tabulation function. In other words, the present invention is suitable for grading up these functions of the self shift PDP since a cursor display line for independent control can be added easily.

Figure 4:
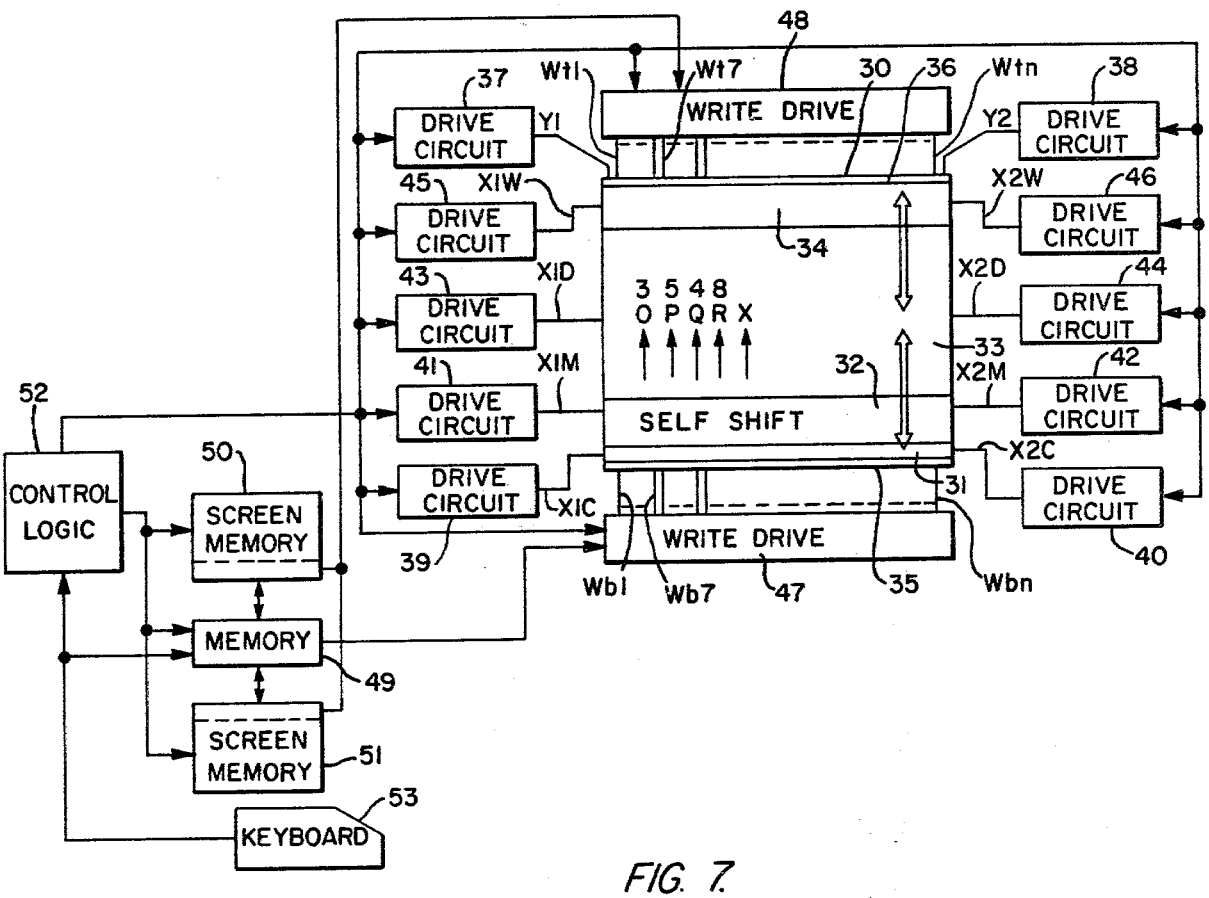
FIG. 4 shows a block diagram indicating another embodiment of the present invention.

FIG. 4 shows a preferred configuration of the self shift PDP 30 which has an added cursor display row 31 and an auxiliary writing row 36 at the upper side of the panel, and of a block diagram of a driving circuit for same. Namely, in FIG. 4, the display screen of the self shift PDP 30 providing many vertical shift channels is divided into four areas: the cursor display row 31, the monitor row area 32 and the display row area 33 and the auxiliary write row area 34 which is provided at the top. Both upper and lower ends of each shift channel are provided with a write discharge cell arrangement 35 and 36 adjacent to the cursor display row 31 and the auxiliary write line 34, respectively. The Y side 2-phase shift electrode groups are extended to the terminals Y1, Y2 in common to the entire display area and then connected to the Y side shift drive circuits 37, 38. However, the X side 2-phase shift electrode groups are extended to a total of four pairs of terminals XIC, X2C and XIM, X2M and XID, X2D and XIW, X2W for each divided display area and then connected to four pairs of X side shift drive circuits 39 to 46, respectively. The write electrode terminals Wb1 to Wbn and Wt1 to Wtn which define the upper and lower write discharge cell arrangements 35 and 36 are connected with the write drive circuits 47 and 48 corresponding to each electrode. The write drive circuit 47 is so configured that it receives data from the editing memory 49 providing a capacity sufficient for storing data corresponding to capacity of of the cursor display row 31 and monitor row area 32, while the another write drive circuit 48 is so configured that it receives selectively the data from two screen memories 50 and 51 having a capacity sufficient for storing data corresponding to the number of letters displayed in the display row area 33 and auxiliary write row area 34.

The editing memory 49 and two screen memories 50, 51 are connected mutually so that they can exchange data between them and the content of the editing memory 49 is shifted to the corresponding position of the screen memory 50 each time display of the monitor row area 32 is shifted to the display row area 33. As in the case of FIG. 2, operation of each point is controlled also by the control logic circuit 52.

When a configuration shown in FIG. 4 is employed, only the cursor display row 31 can be driven selectively. Thus, only the position of cursor associated with the monitor row 32 can be shifted freely in accordance with the cursor shift command signal sent from the keyboard 53, and its position can be confirmed visually and it is sequentially stored in the editing memory 49 in accordance with the content of the monitor row area 32. Therefore, when the cursor display row area 31 and monitor row area 32 are switched to the common shift operation mode at the desired cursor position and simultaneously data for the amendment is keyed in, the preceding display is erased at once on the screen of the monitor row area 32 and thereafter data for a single row including the amendments are written again from the editing memory 49 and displayed.

When it is required to amend the data being displayed already in the display row area 33, the display of a single column including the data to be amended are scrolled down to the monitor row area 32 by means of the shifting in the reversed direction as described above, and data for the relevant single row which is already stored in the screen memory 50 is shifted to the editing memory 49, thereby the data can be amended by making use of the cursor. At the time of said scroll-down, the screen may be blanked out to have no display in the upper part. In order to avoid such blanking, it is desirable to sequentially shift information being scrolled out of the bottom of the display row area 33 from the one screen memory 50 to the other screen memory 51 for controlling input into the auxiliary write row 34 above the display row area and to write again the data being scrolled down to the lower side on the screen by the auxiliary write row. Thereby, once the display is written it can be prevented from being erased at the time of the partial revision. Moreover, providing screen memories 50 and 51 as explained above makes it possible for example, to, sequentially scroll down the rows of displayed information one after another after an entire display frame is once written and displayed in accordance with the transfer of data from the computer, and it is also easy by this method to form a table by writing the required data from the keyboard. The self shift PDP of the present invention is very convenient in that the keyed in data can be written directly into the final display position of the monitor row, in view of attaining such a tabulation function.

In the configuration shown in FIG. 4, the cursor display row 31 is indicated as an independent line, but it can also be provided within the monitor row 32 and therefore the cursor display row should be considered as a part of the monitor row, unless otherwise indicated. Moreover, in the configuration of FIG. 4, the write discharge cell arrangements 35 and 36 provided at both upper and lower ends can also be configured as explained below by a well known method. Namely, one Y electrode group (Y1, for example) maybe individually extended for each shift channel and the X direction write electrode is provided in common to each shift channel corresponding to both end positions of these Y electrode groups. In this case, the write signal is applied selectively to said one Y electrode group. According to such configuration, the write discharge cell arrangements 35 and 36 in both upper and lower sides become effective selectively with the activation timing of said X side write electrode, and thereby the write drive circuits can be used in common for both sides. In addition, the partially selective shift operation explained above is controlled by the indicated control logic circuit 20 or 52, and such circuit can be formed easily as is explained in the previously cited U.S. patent application Ser. No. 906,342 through the combination of the clock pulse generator, drive timing determination and switching counter and various logic circuits. In this case, it is more convenient for improving operability if the shift operation rate can be switched or changed in at least two stages of high and low levels while data is written into the monitor row area and the display data is scrolled up to the display row area from the monitor row area.

As is clear from the above explanation, the self shift PDP and its driving system of the present invention can drastically improve the operability by employing the vertical shift system. On the other hand, the number of write drivers increases as the number of data to be displayed per row increases. Thus, in view of eliminating such disadvantage, the present invention proposes that the resistors and diodes be connected in the form of a matrix by dividing the write electrodes corresponding to each shift channel into several groups and by selecting the write electrode of each group on a time sharing basis.

Figure 5:
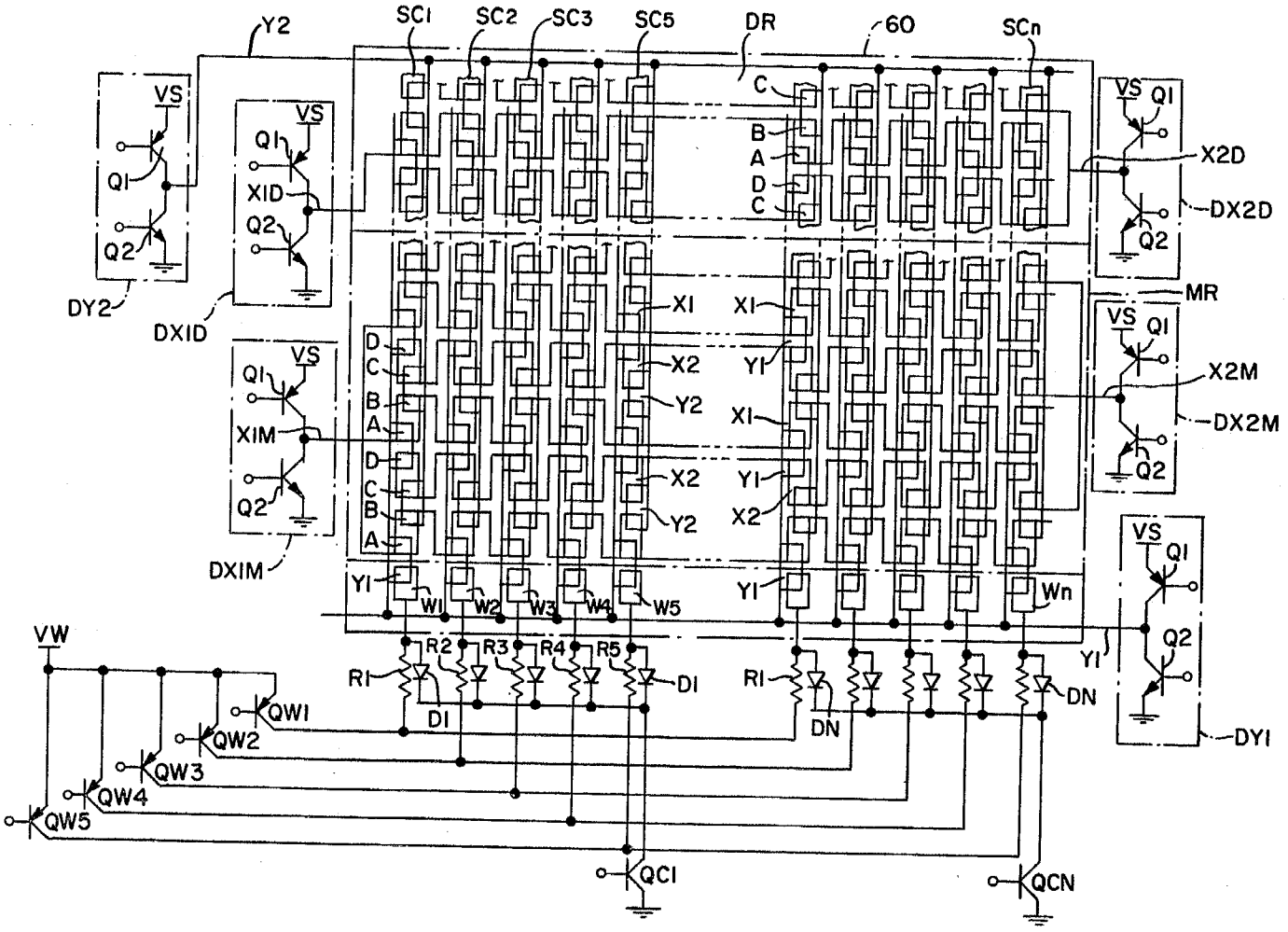
FIG. 5 is given for explaining the electrode configuration of the self shift type gas discharge panel in accordance with an embodiment of the present invention and the driving circuit for the same.

FIG. 5 shows in detail the electrode arrangement of the self shift PDP and an example of the driving circuit for the same, including the configuration of the matrix selective drive circuit for the abovementioned write electrodes. The self shift PDP is not limited only to the type shown in this figure and it may, for instance, comprise the meander electrode configuration. In FIG. 5, the self shift PDP 60 has plural lines of two groups of shift electrodes y1 and y2 which are alternately arranged in the vertical direction on the one substrate and also has plural lines of two groups of shift electrodes x1 and x2 which are alternately arranged in the vertical direction on the other substrate. These electrodes of $2\times2$ groups in both sides are respectively coated by a dielectric layer on each substrate and are arranged face to face via the gaseous gap for discharge as is already known. Thus, in the gap between the four electrode groups y1, y2 and x1, x2 arranged face to face, the 4-phase discharge cells A to D are arranged with a regular period in accordance with the arrangement sequence of these electrodes, and plural vertical shift channels SCl to SCn are formed along the column line of each electrode as shown in the figure. At the lower end of the shift channels SCl to SCn, the write electrodes Wl to Wn (n=5) which are explained above are provided opposite to the first y1 electrodes, and said four shift electrode groups y1, y2, and x1, x2 are extended up to the terminals Y1, Y2, X1M, X2M, X1D, X2D by means of the bus connections at the monitor row MR and display row DR as explained above.

Each shift electrode terminal is connected with one of the shift drive circuits DY1, DY2, DX1M, DX2M, DX1D and DX2D each of which is composed of a pair of transistors Q1 and Q2 as the shift pulser being connected in series between the shift voltage source Vs and ground. The write electrodes Wl to Wn corresponding to all the shift channels SCl to SCn, divided into N character blocks of m channels each, are respectively connected in common according to the N blocks by the diode groups Dl to DN (m=5 in the case of FIG. 5) and corresponding write electrodes in each character block group are connected in common via the resistors R1 to Rm.

Each diode Dl to DN corresponding to each block is respectively connected with a transistor QCN to QCj as the character block selection clamper and resistor groups Rl to Rm are respectively connected with the write transistors QWl to QWm as the write drivers. Here, it is also possible to add a common transistor for generating the sustain pulse via another diode (not illustrated) so that the sustain voltage can be supplied to each write electrode, in order to improve stability of the write operation.

Figure 6:
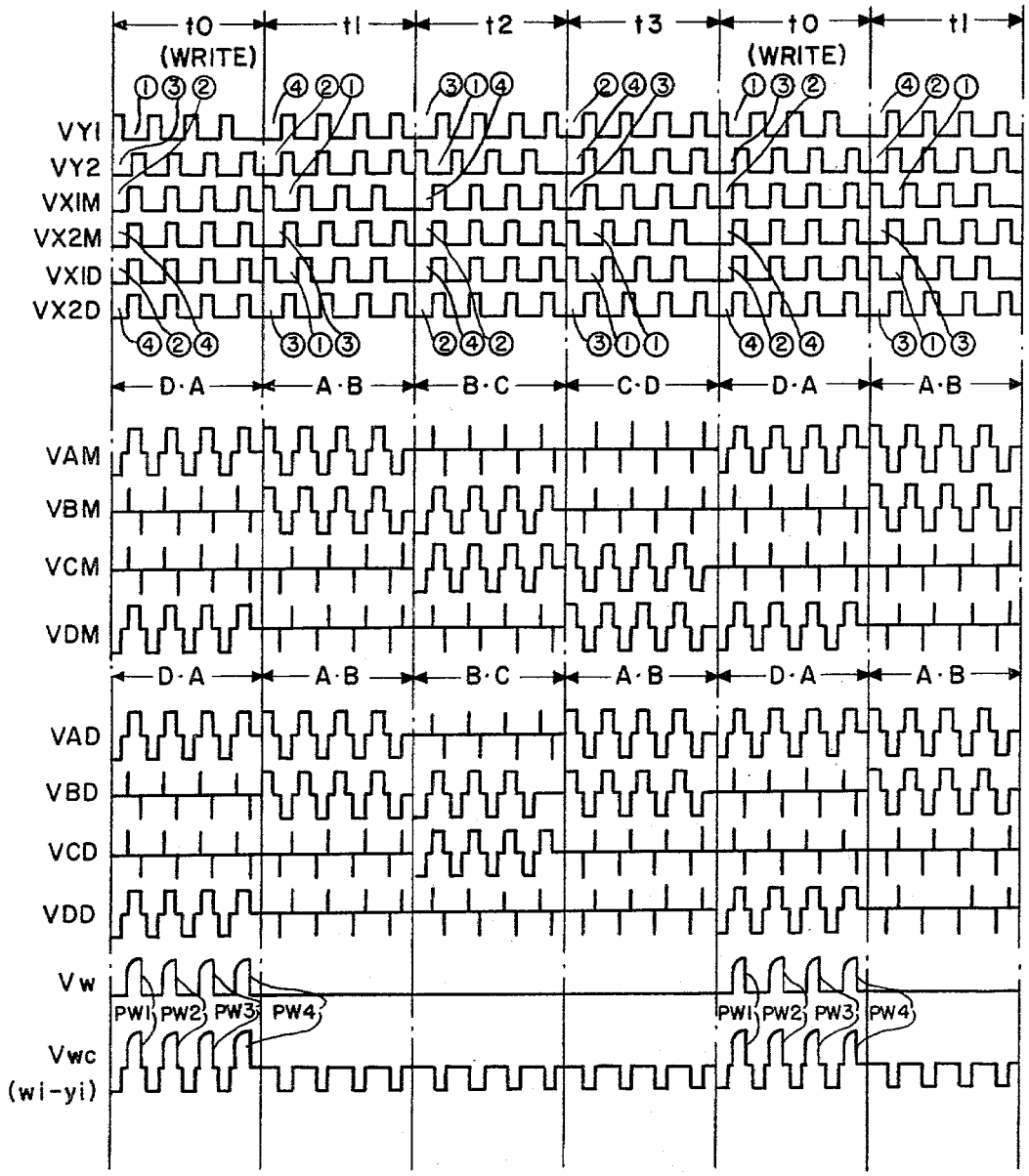
FIG. 6 shows an example of the driving waveforms for the driving circuit shown in FIG. 5.

FIG. 6 shows an example of driving waveforms. VY1 and VY2 in this figure show the waveforms of voltage to be supplied to the Y side common shift electrode terminals Y1 and Y2, while VX1M, VX2M are waveforms of voltages to be supplied to the X side shift electrode terminals X1M and X2M of the monitor row area MR, and VX1D, VX2D are waveforms of voltages to be supplied to the X side shift electrode terminals X1D, X2D of the display row area DR, respectively. In addition, VAM to VDM in FIG. 6 show the waveforms of cell voltages which are applied to the 4-phase discharge cells of the monitor row area MR as the combined voltage waveforms, while VAD to VDD are waveforms of voltages to be supplied to the 4-phase discharge cells of display row area DR as the combined voltage waveforms and VW, VWC are waveforms of voltage to be supplied to the write electrodes and combined voltage waveform to be supplied to the write discharge cells.

Figure 7:
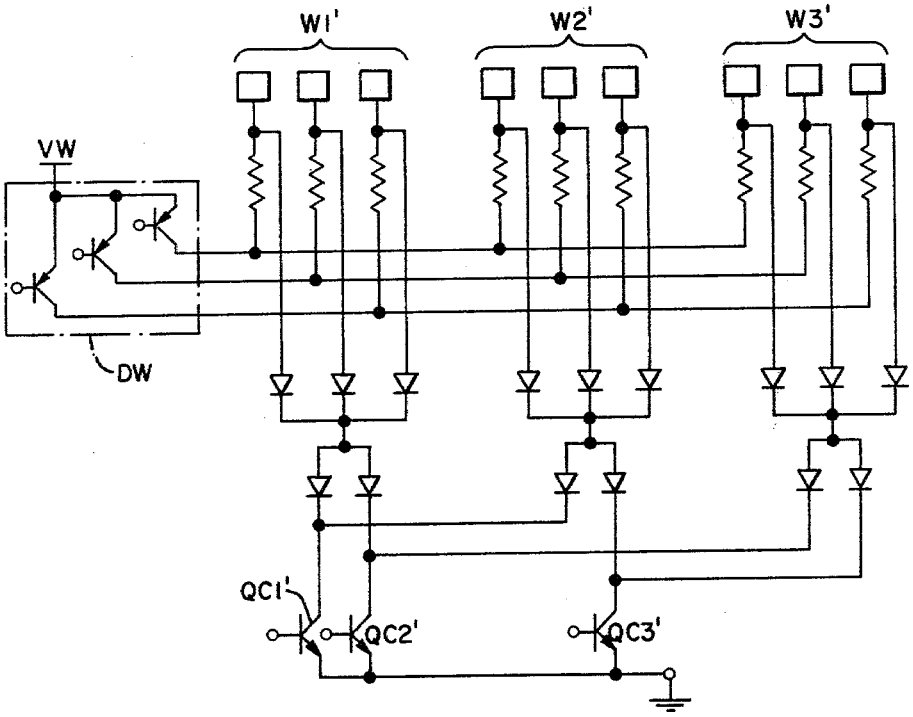
FIG. 7 shows an embodiment of the write electrode selection circuit.

In the relationship between FIG. 5 and FIG. 6, the shift pulse SP which activates the pair of adjacent discharge cells of D.A, A.B, B.C, C.D sequentially through the combinations of the basic pulse trains 1 to 4 applied in the four unit periods t0 to t3 is applied to the discharge cells of monitor row area MR from the corresponding shift drive circuits, thereby shift operation is performed and data writing is conducted in every complete period or cycle of shift operation on a time sharing basis. Namely, the first shift pulse SP of the unit period to is given to the x1 terminal and the write electrodes of a first character block group are selected by the clamp transistors QCl to QCj in such a timing that the y1 electrode facing to the write electrode is put to ground potential. Simultaneously, data writing for this first group can be performed by supplying the write pulse PW1 selectively from the transistors QW1 to QW4 for the write drive, and then data writing of a second group can be performed by selecting the write electrode of the second group in synchronization with the second shift pulse in the unit period to and supplying the write pulse PW2 in the same way. Thus, four time sharing write operations can be realized with such a driving system with the four cycles of shift pulses into as shown in FIG. 6 being considered as one of four unit periods full shift operation cycle or period. The greater the number of times the time sharing write operation is extended in the period of to, the more reduced the number of write drivers can be. During this write period, the sustain voltage is supplied to the write electrodes as described previously at the predetermined timing and more preferably the data written previously is sustained until writing complete for all lines. While the write and shift operations for the monitor row area MR are performed as explained above, the shift pulse is supplied in a different sequence from that for the monitor row area MR to the 4-phase discharge cell groups of the display row area DR as is apparent from VAD to VDD shown in FIG. 6. Thereby the pairs of adjacent discharge cells of D.A, A.B, D.A, C.D, D.A, A.B are sequentially activated. Thus, the reciprocal shift or sway shift is performed by repetition of the shift operation in the reverse direction with the forward shift in the predetermined discharge cell arrangement period. For this reason, display which is already scrolled up to the display row area DR is not erased and is sustained under the display condition. This is very convenient for the operator who keys in the data. Further detailed explanation of such partially selective sway shift operation is described in the above mentioned U.S. patent application Ser. No. 906,342 when not only the X but also the Y side shift electrodes are independently extended for plural shift channels and the display screen is also divided into vertical columns, selective writing for each column can be realized as explained in said U.S. patent application Ser. No. 906,342, by combining said sway shift operation and commonly using the write driver. FIG. 7 shows K=3 clampers selectively connected via N=3 OR gates, each Or gate comprising j=2 diodes and being assigned in common to the write electrode group of a respective display block. These parameters are a solution of the standard combination function for the number N of k things taken j at a time $N=kCj=k!/j!(k-j)$, as effective means for reducing the number of write drivers, while allowing N display blocks to be selected sequentially. In FIG. 7, in conformance to the above formula, the write electrodes are arranged in three blocks W1' to W3', each block consisting of three electrodes, and each group of two blocks may be selected by the k=3 transistors QC1' to QC3' for clamping, and thus the write voltage VW can be applied from the write driver circuit DW which is connected to the write electrode of the selected group via a resistor. As can be understood from the above explanation, since the present invention employs such a panel configuration that the display screen having many shift channels arranged in the vertical direction is divided into at least two areas at a right angle to the shift direction, the data keyed in to the final display position of the one area can be displayed by directly writing it and the optimum self shift display can be obtained as the keyboard input type. In addition, display of the input data is sustained and thereby operator fatigue can be alleviated, operability can be much improved because the data revision and tabulation functions can be realized easily, and thus the field of application of the self shift PDP of this type can be expanded drastically.

It goes without saying that the vertical shift system of the present invention can be adapted not only to the self shift PDP having the meander electrode configuration as shown in FIG. 5, but also to various kinds of self shift PNP having cross electrode configuration as explained previously including the parallel electrode configuration and the meander channel configuration, etc.

What is claimed is:

1. A self shift type gas discharge panel having a display screen comprising shift channels arranged in parallel, each said shift channel being defined by a periodic arrangement of groups of discharge cells in a gas discharge space, said groups of discharge cells being selectively defined by groups of electrodes having a periodic arrangement on two substrates separated by said gas discharge space, said panel comprising:

means for dividing said display screen into at least two areas for selective operation in each of said areas, said at least two areas having at least one common boundary crossing said parallel lines of shift channels at right angles, said dividing means comprising said selective definition of said discharge cell groups by said periodic arrangement of electrode groups being such that said electrode groups on one of said substrates extend in common over each said divided display area and such that at least two of said electrode groups on the other of said substrates are limited to extend selectively over a respective one of said divided display areas, and write electrodes defining write discharge cells provided at at least one end of each said shift channel.

2. A self shift type gas discharge panel wherein the display screen is structured by providing in parallel several lines of shift channels comprising a periodic arrangement of discharge cells of several groups defined by electrode groups provided on two respective substrates across a discharge gap and having a periodic arrangement on each said substrate, said panel comprising dividing means for dividing said display screen into at least two areas in the direction orthogonal to the shift channels, said dividing means comprising one of said electrode groups on one of said substrates being connected in common over the entire display area, and the other electrode groups on the other substrate being individually led out for each of the divided display areas, operating means together with said dividing means for providing independent operation in each said divided display area, and write electrodes for defining write discharge cells being provided at one end of each said shift channel in at least one of said divided display areas.

3. The panel of claim 1 or 2, said groups of electrodes comprising:

at least two of said divided display areas, a first pair of said groups of electrodes arranged alternately on a first one of said substrates and at least two second pairs of said groups of electrodes arranged alternately on the second of said substrates, each of said second pairs corresponding to a respective one of said areas of said divided display screen, two buses on the first of said substrates to connect each said electrode of each group of said first pair of groups in common over the entire display screen, and at least two buses on said second substrate corresponding to each said second pair of electrode groups for connecting in common each electrode of each said second pair of electrode groups corresponding to each said area of said divided display screen.

4. The panel of claim 1 or 2 said shift channels being arranged in the vertical direction of said display screen, and said write electrodes being provided at the lower ends of said shift channels.

5. The panel of claim 4 or 2 comprising at least two of said divided areas, one of said areas comprising a monitor row area located adjacent to said write discharge cells, and another of said areas comprising a display row area located adjacent to the upper side of said monitor row area.

6. The panel of claim 1 comprising said shift channels being arranged in the vertical direction, said display screen being divided into at least three of said divided areas with at least two of said common boundaries aligned in the horizontal direction, and said write electrodes being provided at both ends of each said shift channel.

7. The panel of claim 2, said shift channels being arranged in the vertical direction of said display screen, and said write electrodes being provided at the lower ends of said shift channels.

8. A driving system for a self shift type gas discharge panel having a display screen, said system comprising plural shift channels aligned in parallel in the vertical direction, each of said shift channels being defined by a periodic arrangement of groups of discharge cells, each of said discharge cell groups being defined between opposing portions of respective groups of electrodes periodically arranged on opposing substrates across a discharge space, write electrodes comprising in respective write discharge cells provided adjacent to the lower end of each said shift channel, said periodic electrode arrangement comprising selected ones of said electrode groups being individually extended in said display screen to divide said display screen at least into two areas with a respective common boundary extending in the direction at right angles to said shift channels to define a monitor row area arranged adjacent to said write discharge cells and a display row area arranged adjacent to the upper side of said monitor row area, a shift drive circuit respectively connected to each said group of electrodes to provide independent shift operation for said monitor and display row areas, write drive circuits and a refreshable memory, connected for operating said write electrodes, said memory having memory capacity corresponding to the number of said discharge cells in said monitor row area, and write operation means for operating said panel so that data can be written into said monitor row area while data previously written into said display row area is sustained.

9. The system of claim 8 comprising means for operating in a different sequence said shift drive circuits that are connected to said groups of electrodes of said display row area and said shift drive circuits which are connected to said groups of electrodes of said monitor row areas, for the shift operation in said monitor row area when the write operation is performed for said monitor row, while data displayed in said display row area is sustained by repetition of a forward shift operation and a backward shift operation in at least one spatial period of said periodic cell arrangement in said display row area.

10. The system of claim 8 comprising clamp circuits connected respectively to said write electrodes to define a first grouping of said write electrodes, each said clamp circuit comprising at least one diode, a resistor connected between each said write electrode and a selected one of said write drive circuits to define a second grouping of said write electrodes, and means for driving said clamp circuits sequentially on a time sharing basis during one cycle of said shift operation and for operating said write drive circuits for selectively writing into said write discharge cells according to said first and second groupings.

11. The system of claim 8 comprising

N unit display blocks arranged along the horizontal direction and extending into said monitor and display row areas, each said unit display block comprising n of said shift channels, block selection means for driving said write electrodes comprised within said write drive circuit, said block selection means comprising selection means for said write electrodes, said selection means comprising m switching elements connected between a write voltage source and a respective one of said write electrodes of each one of said display blocks so that the write voltage may be supplied in common to corresponding selected write electrodes in each of said display blocks, k switching elements respectively connected at a first terminal to a reference voltage source and at a second terminal to a common terminal of said n shift channels of each said display block so that all said write electrodes of non-selected ones of said unit display blocks may be clamped simultaneously by the said clampers to the reference voltage, and j diode elements each connecting a respective one of said display blocks to a respective one of said switching elements, wherein said write voltage may be applied only to at least one of said write electrodes of a selected one of said unit display blocks.

12. The system of claim 11 said N, K and j parameters satisfying the equation $N=kCj$.

13. The system of claim 8, said write operation means and said refreshable memory comprising means for revision of data displayed in said monitor row area by selective correction of corresponding data in said memory and for rewriting the entire area of said monitor row area according to said corrected data in said memory.

14. The system of claim 13, said write operation means further comprising means for selectively applying at least one erasing pulse to said electrode groups defining said monitor row area to erase all the data displayed in said monitor row area prior to said rewriting operation based on said corrected data in said memory.

* * * * *

UNITED STATES PATENT AND TRADEMARK OFFICE

CERTIFICATE OF CORRECTION

PATENT NO. : 4,247,802

DATED : January 27, 1981

INVENTOR(S) : Kurokawa

It is certified that error appears in the above—identified patent and that said Letters Patent is hereby corrected as shown below:

Title page, [57] Abstract, line 10, delete "one-".

Column 1, line 28, "age" should be --ages--;

line 35, "assigned" (second occurrence) should be --assignee--;

line 42, after "and" insert --are--;

"assigned" (second occurrence) should be --assignee--;

line 55, after "Thus" insert --,--;

line 56, after "display" insert --,--.

Column 2, line 4, "fatique" should be --fatigue--;

line 32, after "detail" insert --,--;

line 62, "group" should be --groups--;

line 66, "in to" should be --into--.

Column 3, line 1, "of of" should be --of--;

line 5, delete "two";

line 12, after "memory" insert --to--;

line 13, after "ory" delete "to";

line 16, the paragraph beginning with "The write ..." should all be part of the previous paragraph;

line 20, "terms" should be --term--;

line 32, after "diagram" insert --of--;

line 54, after "to" insert --as--.

UNITED STATES PATENT AND TRADEMARK OFFICE

CERTIFICATE OF CORRECTION

PATENT NO. : 4,247,802

DATED : January 27, 1981

INVENTOR(S) : Kurokawa

It is certified that error appears in the above—identified patent and that said Letters Patent is hereby corrected as shown below:

Column 4, line 1, before "12" insert --area--;
line 4, "in shown" should be --shown in--;
line 46, "follow:" should be --follows:--;
line 47, after "display" insert --row area--;
line 52, "spot" should be --spots--;
line 53, delete "an";
line 59, "advantage" should be --advantages--;
line 60, "view point" should be --viewpoint--;
line 64, "displays" should be --display--.

Column 5, line 17, "the" should be --a--; after "and" insert --a--;
line 46, after "for" insert --the--;
line 53, "al," should be --al.--;
line 57, after "display" insert --row--;
line 63, before "down" insert --row area 12 is scrolled--;
line 68, "function" should be --functions--.

Column 6, line 7, after "for" insert --the--;
line 31, delete "of";
line 33, delete "the".

Column 7, line 15, after "possible" insert --,--;
line 16, after "to" delete ",";

UNITED STATES PATENT AND TRADEMARK OFFICE

CERTIFICATE OF CORRECTION

PATENT NO. : 4,247,802

DATED : January 27, 1981

INVENTOR(S) : Kurokawa

It is certified that error appears in the above—identified patent and that said Letters Patent is hereby corrected as shown below:

line 24, "keyed in" should be --keyed-in--;
line 34, "well known" should be --well-known--;
line 35, "maybe" should be --may be--.

Column 8, line 17, "face" should be --face- --;
line 18, "to face" should be --to-face--;
line 20, "face to face" should be --face-to-face--;
line 35, after "DX2D" insert --,--;
line 47, "QCN to QCj" should be --QC1 to QCN--.

Column 9, line 3, after "waveforms" insert --,--;
line 13, after "circuits," insert --and--;
line 17, "to" (first occurrence) should be --t0--;
line 19, "QCj" should be --QCN--;
line 27, "to" should be --t0--;
line 29, after "system" insert --,--;
line 30, delete "into";
line 31, after "periods" insert --of the--;
line 34, "to" should be --t0--;
line 37, after "timing" insert --,--;
line 39, after "writing" insert --is--;
line 44, after "DR" insert --,--;
line 56, "above mentioned" should be --above-mentioned--;

UNITED STATES PATENT AND TRADEMARK OFFICE

CERTIFICATE OF CORRECTION

PATENT NO. : 4,247,802

DATED : January 27, 1981

INVENTOR(S) : Kurokawa

It is certified that error appears in the above—identified patent and that said Letters Patent is hereby corrected as shown below:

line 57, after "906,342" insert --.--; "when" should be --When--, and should begin a new paragraph;

line 64, after "driver." begin new paragraph with "FIG. 7";

line 65, "K" should be --k--;

line 66, "Or" should be --OR--.

Column 10, lines 4-25, the indented paragraph should not be indented but should be part of the text, and should further be corrected as follows:

line 1 of the indented paragraph, "(k-j)" should be --(k-j)!--, and after "as" insert --an--;

line 4 of the indented paragraph, change "to" to --with--;

line 29, "PNP" should be --PDP--.

Column 13, line 7, after "11" insert --,--; "K" should be --k--.

Signed and Sealed this

First Day of December 1981

[SEAL]

Attest:

GERALD J. MOSSINGHOFF

Attesting Officer

Commissioner of Patents and Trademarks